United States Patent [19]

Briére

[11] Patent Number: 4,979,999

[45] Date of Patent: Dec. 25, 1990

[54] TRACER COMPOSITION AND METHOD OF PRODUCING SAME

[75] Inventor: Paul Briére, Neufchatel, Canada

[73] Assignee: Minister of National Defence of Her Majesty's Canadian Government, Ontario, Canada

[21] Appl. No.: 533,412

[22] Filed: Jun. 5, 1990

[30] Foreign Application Priority Data

Sep. 29, 1989 [CA] Canada ..... 615092

[51] Int. Cl.[5] ..... C06G 45/32

[52] U.S. Cl. ..... 149/6; 149/19.3; 149/43; 149/44; 149/61; 149/109.6; 264/3.4

[58] Field of Search ..... 149/6, 19.3, 43, 44, 149/61, 109.6; 264/3.4

[56] References Cited

U.S. PATENT DOCUMENTS

| | | | |
|---|---|---|---|
| 3,862,865 | 1/1975 | McManus et al. | 149/44 |
| 3,886,009 | 5/1975 | Puchalski | 149/44 |
| 3,972,291 | 8/1976 | Braun et al. | 149/43 |
| 4,094,711 | 6/1978 | Ramnarri | 149/6 |
| 4,302,259 | 11/1981 | Ward | 149/61 |
| 4,597,810 | 7/1986 | Trickel et al. | 149/43 |

*Primary Examiner*—Stephen J. Lechert, Jr.
*Attorney, Agent, or Firm*—Nixon & Vanderhye

[57] ABSTRACT

A tracer composition with a relatively high luminous output and a moderate burn rate includes from 35 to 47% by weight magnesium; from 40 to 53% by weight strontium nitrate, from 2 to 10% by weight magnesium carbonate, from 0 to 6% by weight color intensifier; from 0 to 6% by weight retardant and from 3 to 8% by weight of a synthetic polymer binder selected from the group consisting of (i) a terpolymer of vinylidene fluoride, hexafluoropropylene and polytetrafluoroethylene and (ii) a copolymer of vinylidene fluoride and hexafluoropropylene. The composition is produced by dry mixing all of the ingredients except the magnesium and binder, dissolving the binder in a solvent such as acetone, forming a homogeneous mixture of particulate magnesium and binder solution, adding a non-solvent such as hexane to the mixture to initiate precipitation of the binder, mixing the dry mixture with the magnesium/binder combination, and adding additional non-solvent to complete precipitation of the binder, and drying the mixture thus produced.

12 Claims, No Drawings

TRACER COMPOSITION AND METHOD OF PRODUCING SAME

This invention relates to a method of producing a tracer composition and to the composition thus produced.

Tracer compositions are commonly loaded into military ammunition. The compositions are intended to produce a bright red flame at the trailing end of the projectile which permits visual observation of the projectile trajectory. The tracers must meet vigorous NATO specifications for each calibre of projectile. Such specifications include minimums for the observable distance of the tracer and for the storage life of the composition. With the acceptance of smaller ammunition such as 5.56 mm as NATO standards for small arms ammunition, existing tracer compositions barely comply with all user requirements. The decreased volume allocated for the tracer composition is a direct cause of the problem. In order to compensate for the decreased quantity of tracer composition used in projectiles, the performance of the composition must be improved, i.e. the luminous output of the composition must be substantially increased while the burning rate remains essentially unchanged.

Tracer compositions, like other pyrotechnic compositions, are basically a mixture of an oxidizing agent (often strontium nitrate), and a metallic fuel (usually magnesium). Other materials are added to the mixture to modify the burning rate and colour and to increase handling safety. Important additives include colour intensifiers, which are mainly highly chlorinated organic compounds; binders such as resins, waxes and elastomers; water proofing agents such as resins, waxes and oils; and retardants, which are usually inorganic salts, plastics or oils. The choice of the binder is important, because the binder can perform many functions in the compositions. While the binder is used primarily to hold the ingredients together after the composition has been pressed, the binder can also act as a colour intensifier if it contains chlorine or fluorine, a water-proofing agent and/or a retardant.

It is well established that decreasing the weight percentage of retardant and/or increasing the weight percentage of the fuel from a stoichiometric composition will usually increase the light output. Moreover, the particle size of the fuel has a substantial effect on the light output and burning rate.

The method used to prepare a pyrotechnic composition is as important as the ingredients used in the composition. The same formulations prepared using different processes will usually perform differently from each other. The usual methods of producing pyrotechnic compositions include (1) dry processing which is the simple blending of dry ingredients, (2) wet processing in which a binder is dissolved or melted and dry ingredients are incorporated in the binder, and (3) a combination of dry and wet processing. The binder often dictates the processing method, because some binders are difficult to dissolve or melt, while other binders are sold in the form of large particles which must be dissolved or melted in order to be incorporated into the composition. Two examples of tracer compositions and their performances as measured in the laboratory are provided in Table I.

TABLE I

| Ingredients | Weight % Composition 1 | Weight % Composition 2 |
|---|---|---|
| Magnesium powder | 25.5 | 38.0 |
| Strontium nitrate | 56.0 | 42.8 |
| Strontium oxalate | 4.8 | |
| Molybdenum disulfide | 1.9 | |
| Polyvinyl chloride | 11.8 | |
| Shellac | | 4.8 |
| Chlorinated rubber | | 4.8 |
| Magnesium carbonate | | 4.8 |
| Beeswax | | 4.8 |
| Processing method | dry | wet |
| Specific luminous efficiency ($cd.s.g^{-1}$) | 1780 | 2771 |
| Burning rate (mm/s) | 3.8 | 8.3 |

An increase in light output of an illuminating composition by increasing the fuel/oxidizer ratio, by decreasing the weight percentage of retardants or changing the particle size of the fuel will, in general, result in a faster burn rate, i.e. shorter trace duration which is undesirable. The results listed in Table I illustrate the effect of a higher weight percentage of fuel. The second composition, which contains almost 50% more magnesium, has a substantially higher luminous output and burn rate than the first composition.

Each method of preparing a pyrotechnic composition has its own advantages and disadvantages. Dry processing is the simplest and quickest method. However, the composition thus produced is more difficult to load, less uniform in terms of ignition and burning, more hazardous to produce because of possible ignition by static electricity and more susceptible to attack by moisture. Magnesium contained in the composition is susceptible to corrosion if there is any moisture present, and strontium nitrate is very hygroscopic. Magnesium reacts with small amounts of water to yield hydrogen and corroded magnesium, which is useless as a fuel. During wet processing, the magnesium and other ingredients are coated and thus protected against moisture. The wet processing method is more safe and usually results in compositions which are less sensitive to external stimuli such as impact and static electricity. However, because of the more intimate mixture of ingredients, the composition usually burns faster without producing a greater luminous output.

An object of the present invention is to provide a solution to the above-identified problems by providing a relatively simple, effective wet processing method, which yields a tracer composition with a high luminous output and a moderate burning rate, the performance of the composition being repetitive from batch to batch.

Another object of the invention is to provide a method which produces homogeneous mixtures having consistent particle sizes from batch to batch, and which is thus less hazardous for mass production purposes, and provides excellent protection of the magnesium against moisture attack.

According to one aspect, the present invention relates to a process for producing a tracer composition of the type including magnesium, strontium nitrate, magnesium carbonate, and a synthetic polymer binder, said method including the steps of (a) dry mixing all solid ingredients except the magnesium and binder to form a first mixture, (b) dissolving the binder in a first solvent; (c) forming a homogeneous second mixture of particulate magnesium and binder solution; (d) adding a second solvent in which the binder is insoluble to the second mixture to cause precipitation of the binder onto magnesium particles; (e) mixing the first mixture with the thus produced sticky coated magnesium particles; (f) adding additional second solvent to complete precipitation and to stick ingredients of first mixture onto coated magnesium particles; and (g) drying the composition thus produced to yield binder coated magnesium, strontium nitrate and magnesium carbonate.

According to a second aspect, the invention relates to a particulate tracer composition comprising from 35 to 47% by weight magnesium; from 40 to 53% by weight strontium nitrate, from 2 to 10% by weight magnesium carbonate, from 0 to 6% by weight colour intensifier; from 0 to 6% by weight retardant and from 3 to 8% by weight of a synthetic rubber binder.

During development of the wet processing method of the present invention, magnesium and strontium nitrate were used as the fuel and oxidizer pair. It was observed that coating the magnesium only using a rubber polymer binder, preferably containing a high percentage of fluorine, yields the best results in terms of performance. The fluorine contained in the binder is considered to be an oxidizer and reacts with the magnesium according to a fuel-oxidizer reaction. Thus, the fluorine contributes to the combustion exothermicity of the composition. A small quantity of magnesium carbonate is required to retard the burning rate, and to permit adequate propagation of the combustion front throughout the entire composition. Composition 3 of Table II, yields excellent results.

TABLE II

| | |
|---|---|
| 43.5% | Mg, type I, Grade A, 120–200 mesh |
| 47.5% | $Sr(NO_3)_2$, anhydrous, reagent, <120 mesh |
| 5.0% | $MgCO_3$, reagent, <100 mesh |
| 4.0% | Kynar 9301 (trademark) from Penwalt Co., terpolymer of vinylidene fluoride, hexafluoropropylene and polytetrafluoroethylene (>>60% in fluorine content) |

Specific luminous efficiency = 3980 $cd.s.g^{-1}$
Burning rate = 6.4 mm/s

In general terms, the process of the present invention includes the steps of dissolving the polymer in a solvent such as acetone, adding dry ingredients to the solvent while stirring vigorously, and then adding a second solvent (a non-solvent) such as hexane in which the polymer is insoluble to effect precipitation of the mixture. Since only the magnesium is to be coated, and since dry mixing is to be avoided throughout the process, the ingredients are added in two separate and distinct steps at specific intervals. The moment at which ingredients are introduced into the mixture is important.

In greater detail, the method of the present invention involves the following steps:

Part 1 - Preparation of Ingredients

1. Dry the strontium nitrate at 105° C. for at least 12h.
2. Dissolve the binder (Kynar 9301) in acetone to yield a solution of 5% by weight.

Part 2 - Dry Premix

3. Dry mix the strontium nitrate, magnesium carbonate and any other ingredients, except the magnesium.

Part 3 - Precipitation (Phase I)

4. Pour the required quantity of binder solution into a glass reactor equipped with a mixer blade.
5. Turn on the mixer.
6. Add the desired weight of magnesium to the solution and stir until the mixture is homogeneous.
7. Using a 1.87 hexane-acetone ratio, calculate the amount of hexane required to cause complete precipitation. Pour 40% of the hexane into a first addition separatory funnel (ASF) and the remainder into a second ASF.
8. Add the hexane of the first ASF to the magnesium mixture at maximum flow rate. During this addition of hexane, the mixer must stir the mixture vigorously.

Part 4 - Precipitation (Phase II)

9. Add the dry premix of ingredients to the magnesium mixture and stir well.
10. Add the hexane of the second ASF to the mixture thus produced at a slow rate. It should take 5 to 7 min. to pour all of the hexane. During this time, the mixer must stir the mixture vigorously.
11. Stir for about 5 min.
12. Turn off the mixer and let the mixture sit for about 5 min.
13. Decant.

Part 5 - Washing Operation

14. Pour a quantity of hexane equivalent to 80% of the quantity calculated in step 7 into a container.
15. Turn on the mixer.
16. Dump the hexane into the reactor.
17. Stir for about 5 min.
18. Turn off the mixer and let the mixture sit for about 5 min.
19. Decant.

Part 6 - Drying Operation

20. Pour the paste thus produced into a large tray, and put the tray into a heated oven at 50° C.
21. When dry, remove the tray from the oven and screen the composition through a 30 U.S. mesh sieve to break any stuck particles.

NOTE If it is desired to avoid screening the composition at step 21, carry out a second washing operation (steps 15–19) before performing step 20.

Typical formulations of the improved tracer compositions of the present invention include the ingredients set out in Table III.

TABLE III

| Ingredient | Percent by Weight |
|---|---|
| Mg | 35–47% |
| $Sr(NO_3)_2$ | 40–53% |
| $MgCO_3$ | 2–10% |
| Color intensifier | 0–6% |
| Retardant | 0–6% |
| Synthetic rubber binder | 3–8% |

The composition should be composed of relatively fine, light grey particles. Approximately 90% of the particles should have a size range of 90–180 um.

The choice of binder is important. For the specific example set out above, the binder must be soluble in acetone and must not be attacked by hexane. The binder must be capable of uniformly coating the magnesium, and finally just be reactive (preferably containing a high weight percent of fluorine). The two preferred binders Kynar 9301 and Viton A (Trade Mark) are available from Penwalt Co and DuPont Co., respectively. The other ingredients should also be chosen carefully. In order to be effective, the ingredients must not be attacked by either solvent. If one of the ingredients is soluble in acetone, a second coating could be deposited on the magnesium, or an initial coating could be formed on the other ingredients which could result in some rather undesirable effects on composition performance. If one of the ingredients is soluble in hexane, the ingredient may be lost from the composition during decanting - again with negative effects on performance.

The compositions which have been found to give the best performances are set out in Table IV.

TABLE IV

| Ingredients | Weight % | |
|---|---|---|
| | Composition 4 | Composition 5 |
| Mg | 42.5 | 42.5 |
| $Sr(NO_3)_2$ | 46.5 | 46.5 |
| $MgCO_3$ | 5.0 | 5.0 |
| Polyvinyl chloride | 2.0 | |
| Shellac | | 2.0 |
| Kynar 9301 | 4.0 | 4.0 |
| Specific luminous efficiency ($cd.s.g^{-1}$) | 4568 | 4256 |
| Burning rate (mm/s) | 6.2 | 6.0 |

Thus there has been described a relatively efficient, yet safe method of producing a particulate tracer composition. The addition of the magnesium to the binder solution followed by a portion of the non-solvent initiates binder precipitation onto the magnesium. When almost all of the binder is in a gel state, the process is stopped and the other ingredients are added. The other ingredients stick to the gel surface and then precipitation is completed, i.e. the gel binder is hardened onto the magnesium with the other ingredients stuck to its outer surface.

The two phase precipitation method results in a homogeneous mixture in terms of particle size distribution and ingredient dispersion. The use of a reactive binder containing a high weight percentage of fluorine which coats only the magnesium and sticks the other ingredients to the coated magnesium particles is an important feature of the invention. It is believed that the magnesium reacts exothermically with the fluorine in the binder, in addition to the main reaction with the principal oxidizer.

Processing the composition is not only effective, but decreases the hazards normally associated with the production of such energetic materials. Since all ingredients are introduced into a wet mixture, the dry mixing hazards such as dust explosions and sensitivity to static discharges are avoided. Compared to similar compositions, the compositions of the present invention provide a substantial improvement in light output combined with a moderate burn rate. Moreover, the magnesium i more than adequately protected against moisture.

The embodiments of the invention in which an exclusive property or privilege is claimed are defined as follows:

1. A process for producing a tracer composition of the type including magnesium, strontium nitrate, magnesium carbonate, and a synthetic polymer binder, said method including the steps of (a) dry mixing all solid ingredients except the magnesium and binder to form a first mixture, (b) dissolving the binder in a first solvent; (c) forming a homogeneous second mixture of particulate magnesium and binder solution; (d) adding a second solvent in which the binder is insoluble to the second mixture to cause precipitation of the binder onto magnesium particles; (e) mixing the first mixture with the thus produced sticky coated magnesium particles; (f) adding additional second solvent to complete precipitation and to stick ingredients of first mixture onto coated magnesium particles; and (g) drying the composition thus produced to yield binder coated magnesium, strontium nitrate and magnesium carbonate.

2. A process according to claim 1, wherein said mixing step (e) is performed by adding the first mixture to a mixture of second solvent and magnesium; and adding additional second solvent to the mixture thus produced.

3. A process according to claim 1, wherein said binder is selected from the group consisting of (i) a terpolymer of vinylidene fluoride, hexafluoropropylene and polytetrafluoroethylene and (ii) a copolymer of vinylidene fluoride and hexafluoropropylene.

4. A process according to claim 1, wherein said first solvent is acetone and said second solvent is hexane.

5. A process according to claim 4, wherein the composition includes 35 to 47% by weight magnesium; from 40 to 53% by weight strontium nitrate, from 2 to 10% by weight magnesium carbonate, from 0 to 6% by weight colour intensifier; from 0 to 6% by weight retardant and from 3 to 8% by weight of said synthetic polymer binder.

6. A process according to claim 5, wherein the composition includes 42.5% by weight magnesium; 46.5% by weight strontium nitrate; 5.0% by weight magnesium carbonate; 2.0% by weight polyvinyl chloride and 4.0% by weight of a vinylidene fluoride, hexafluoropropylene and polytetrafluoroethylene terpolymer.

7. A process according to claim 5, wherein the composition includes 42.5% by weight magnesium; 46.5% by weight strontium nitrate; 5.0% by weight magnesium carbonate; 2.0% by weight shellac and 4.0% by weight of a vinylidene fluoride, hexafluoropropylene and polytetrafluoroethylene terpolymer.

8. A particulate tracer composition comprising from 35 to 47% by weight magnesium; from 40 to 53% by weight strontium nitrate, from 2 to 10% by weight magnesium carbonate, from 0 to 6% by weight colour intensifier; from 0 to 6% by weight retardant and from 3 to 8% by weight of a synthetic polymer binder.

9. A composition according to claim 8, in which the size of at least 90% of the particles is from 90 to 180 um.

10. A composition according to claim 8, wherein said binder is selected from the group consisting of (i) a terpolymer of vinylidene fluoride, hexafluoropropylene and polytetrafluoroethylene and (ii) a copolymer of vinylidene fluoride and hexafluoropropylene.

11. A composition according to claim 10, including 42.5% by weight magnesium; 46.5% by weight strontium nitrate; 5.0% by weight magnesium carbonate; 2.0% by weight polyvinyl chloride and 4.0% by weight of a vinylidene fluoride, hexafluoropropylene and polytetrafluoroethylene terpolymer.

12. A composition according to claim 10, including 42.5% by weight magnesium; 46.5% by weight strontium nitrate; 5.0% by weight magnesium carbonate; 2.0% by weight shellac and 4.0% by weight of a vinylidene fluoride, hexafluoropropylene and polytetrafluoroethylene terpolymer.

* * * * *